United States Patent [19]

Shields

[11] Patent Number: 4,697,336

[45] Date of Patent: Oct. 6, 1987

[54] AIR DISCHARGE SYSTEM FOR USE WITH CONNECTOR APPLYING MACHINES

[76] Inventor: Charles E. Shields, 655 Woodland, Crystal Lake, Ill. 60014

[21] Appl. No.: 889,399

[22] Filed: Jul. 25, 1986

[51] Int. Cl.[4] ..... H01R 43/04

[52] U.S. Cl. ..... 29/753; 29/809; 221/278

[58] Field of Search ..... 29/753, 748, 809, 857, 29/861, 863, 865, 866, 564.1; 221/278, 133, 200

[56] References Cited

U.S. PATENT DOCUMENTS

| | | | |
|---|---|---|---|
| 3,447,229 | 6/1969 | Clark | 29/809 |
| 4,580,340 | 4/1986 | Shields | 29/749 |
| 4,627,156 | 12/1986 | Vancelette | 221/278 |

FOREIGN PATENT DOCUMENTS

| | | | |
|---|---|---|---|
| 21236 | 2/1982 | Japan | 29/809 |

*Primary Examiner*—Percy W. Echols

*Attorney, Agent, or Firm*—Hill, Van Santen, Steadman & Simpson

[57] ABSTRACT

There is disclosed herein an apparatus for applying electrical connector sections to a flat multiconductor cable. The apparatus includes a multiconductor cable, and a connector station which includes two connector applying sections. Each section includes a connector supplying magazine or feed for delivering a connector section from the supply magazine to tooling which receives the connector section. Air cylinders advance the tooling to the cable for securement of the connectors thereto and retract the tooling from the connector receiving position. A pair of outlet valves are associated with each pneumatic cylinder and air discharge lines extend between one of the valves and the connector termination position and the other of the valves and the connector magazine feed for selectively discharging air into the magazine as the tooling is extended and for discharging air toward the connector termination position as the valving is retracted so as to enhance free movement of the connector sections in the magazine and release the connectors from the tooling at the connector terminating position.

5 Claims, 1 Drawing Figure

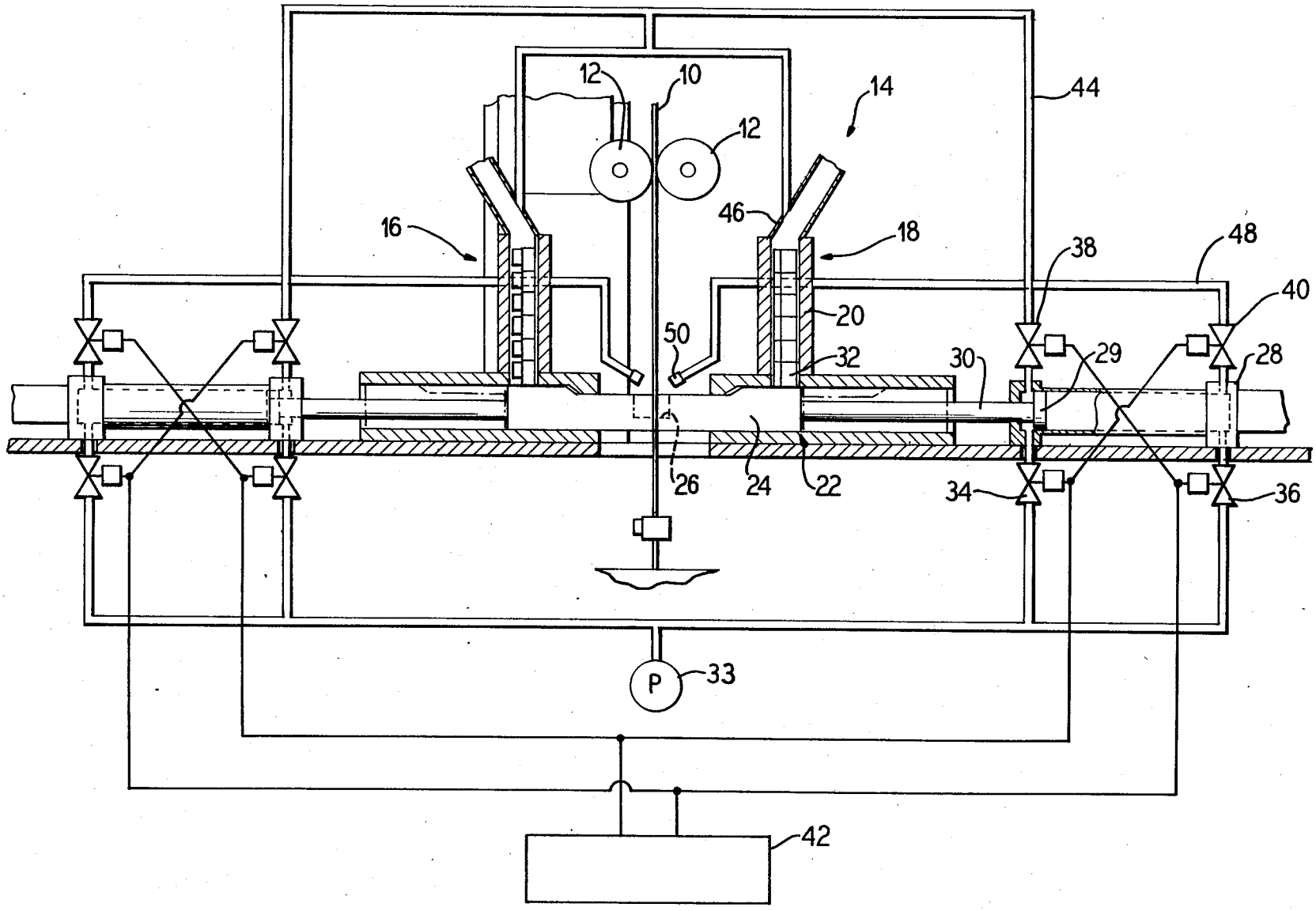
40
28
36
48
29
44
38
34
30
18
14
20
32
22
42
46
24
12
33
10
50
26
P
12
16

AIR DISCHARGE SYSTEM FOR USE WITH CONNECTOR APPLYING MACHINES

BACKGROUND OF THE INVENTION

This invention relates to the method and apparatus for applying connectors to electrical conductors, and more particularly, to applying connectors to flat multiconductor cable of the type used in the electrical industry, particularly the computer industry.

Flat cable multiconductor cables are used extensively in the computer industry to interconnect various electronic components and systems. The actual electrical connection is made by electrical connectors which are staked to or terminated on the cable. Each connector includes a pair of sections or halves which include a body and a cap for contacting the conductors, for sandwiching the cable between the connector halves and for securing the connector to the cable. The body portion includes a plurality of tine-like contacts which cut the conductor insulation and electrically contact the conductors. The cap engages the conductor body, positions the cable between the cap and body, and secures the conductor to the cable.

Machines for terminating or staking a connector to a cable are known in the art and one such machine is disclosed in U.S. Pat. No. 4,580,340. In that machine the cable is fed from a reel to a cable assembly or connector applying station. Each station includes a pair of connector section feed devices or magazines, connector receiving tooling and pneumatic rams for moving the tooling between a connector receiving position and an extended connector staking or terminating position. The tooling includes inserts which form a shelf or recess for receiving the connector portion and for use in staking the connector portion onto the cable. In the retracted position, the tooling receives a connector portion, and in the extended or advanced position, the tooling cooperates in staking the connector onto the cable.

It has been found that connector portions may become jammed or hang up in the magazine.

It is therefore an object of this invention to prevent or minimize the likelihood of the connector portions jamming or hanging up in the connector feed or magazine.

Furthermore, in order to secure or stake the connector to the cable, the connector portions are received on a tooling ledge or shelf which is advanced to the cable for staking and securement and then retracted leaving the connector on the cable. It has been found that the connector portion may jam or hang up on the tooling and is not readily released from the tooling as it retracts from the staked connector.

It is therefore another object of this invention to enhance release of the connector from the tooling as it is retracted after staking.

These and other objects of this invention will become apparent from the following description and appended claims.

SUMMARY OF THE INVENTION

There is provided by this invention an air discharge system associated with the pneumatic rams which operate the connector applying tooling for directing a stream of air through the connector feed magazines so as to minimize jamming or hanging up of the connector portions in the magazine.

Other air discharge lines are associated with the rams for directing a stream of air to the connector and tooling as it is staked on the cable so as to release the connector from the cable.

The rams are pneumatic and the air discharges are associated with the discharge side of the ram in its different modes of operation.

BRIEF DESCRIPTION OF THE DRAWING

The drawing is a diagrammatic side view of a connector applying system and shows the air discharge system of this invention.

DESCRIPTION OF THE PREFERRED EMBODIMENT

Referring now to the drawing, the connector applying machine includes a cable feed system (not shown) whereby a cable 10 is fed past guide rollers such as 12 and through a connector applying station 14 generally. The station includes two sections 16 and 18 on either side of the cable 10. Each section includes a vertical connector portion feed magazine, such as 20, which is positioned above connector applying tooling 22. The tooling includes a body section 24 having a connector receiving shelf or insert section, such as 26. The tooling is slidably mounted below the magazine 20 and is advanced and retracted toward cable 10 by a pneumatic ram or piston system which includes a cylinder 28 having therein a piston 29 and connected thereto to a rod 30. In the retracted position, the piston is remote from the cable 10 or toward the outboard side of the cylinder 28, the rod 30 is retracted into the cylinder, and the tooling is retracted so that the insert 26 is directly below the magazine.

A connector section, such as 32, then falls into the insert for advancement toward the cable. It will be understood that both sections 16 and 18 operate in the same manner. In order to secure the connector to the cable, the cylinder is activated so as to cause the rod 30 to extend, thereby moving the tooling 22 with the connector section toward the cable into a staking position.

Each of the cylinders is operated by a pump 31 connected to inlet valving 34 and 36. Outlet valving 38 and 40 is provided. All of the valving is controlled by a controller 42. The outlet valve 38 is connected to the line 44, which discharges into the top of the connector magazine 20 at orifice 46. The outlet valve 40 is connected to line 48, which discharges at the connector staking position 50.

In operation, beginning with the tooling in the retracted position, the cylinder rod 30 is retracted and the piston 29 is retracted inside the cylinder. In that position the inlet valve 36 is opened so as to direct air into the cylinder, and the outlet valve 38 is opened. Thus incoming air pushes the piston 29, piston rod 30 and tooling 22 toward the extended position. As this is happening, outlet air is discharged from the cylinder 28, through valve 38, through the line 44 and exits at the orifice, such as 46. The discharge air from the line 44 pushes down on the connector sections so as to enhance the gravity feed and also to loosen the connector portions therein. This provides a more positive feed mechanism for the connector sections in the magazine.

In order to retract the tooling, the valves 36 and 38 are closed and the valves 34 and 40 are opened. Incoming air flows into the cylinder through valve 34 and pushes the piston and cylinder rod and tooling toward the retracted position. Outlet air from the cylinder exits via the exit valve 40 and through line 48 and is discharged at the orifice or terminal 50. The terminal is directed so that the discharged air blows the terminated connector off of the tooling 22, and particularly the ledge or insert 26 so as to loosen the connector and release it from the tooling so that the cable can be advanced to the next termination position.

Although the invention has been described with respect to preferred embodiments, it is not to be so limited as changes and modifications can be made which are within the full intended scope of the invention as defined by the appended claims.

I claim as my invention:

1. An apparatus for applying electrical connector sections to a flat multiconductor cable which includes supply means for supplying a multiconductor cable, a connector applying station for receiving said cable and applying an electrical connector, said station including two connector applying sections, each section having connector supply magazine means, tooling means for receiving a connector section and pneumatic cylinder means for advancing the tooling means to the cable for securement of the connector thereto and for retracting the tooling to a connector receiving position, wherein the improvement comprises at least one of said pneumatic cylinder means including a pair of outlet valve means, first air discharge line means extending between one of said valve means and a connector termination position and a second air discharge line means extending between the other of said outlet valve means and the magazine feed means for selectively discharging air into the magazine means as the tooling is extended toward the connector termination position and for discharging air toward the connector termination position as the tooling is retracted.

2. An apparatus as in claim 1, wherein said outlet valve means associated with said magazine feed means is operatively connected to the cylinder means for receiving discharged air from the cylinder means as the tooling is extended.

3. An apparatus as in claim 1, wherein said outlet valve means associated with the connector terminating position is operatively connected to the cylinder means for receiving discharged air from said cylinder means as the tooling is retracted.

4. An apparatus as in claim 1, wherein said cylinder means is further provided with a pair of air inlet valves for use in supplying air to said cylinder means for selectively extending or retracting said tooling, the extension air inlet valving means and the magazine discharge outlet valving means comprising a first valve group that is opened simultaneously for extension of the tooling and air discharge to the magazine and said first valve group being closed upon retraction; and the retraction inlet valve means and outlet valve means for discharge to said connector terminating position comprising a second valve group that is opened for retraction of the tooling and said second valve group being closed upon extension.

5. An apparatus as in claim 1, wherein each of said pneumatic cylinder means includes a pair of outlet valve means, first air discharge line means and second air discharge line means.

* * * * *